US006154912A

United States Patent [19]

Li

[11] Patent Number: 6,154,912

[45] Date of Patent: Dec. 5, 2000

[54] WATER-PROOF ELECTRONIC SOUND AND LIGHT TOOTHBRUSH

[76] Inventor: Hun-Pien Li, P.O. Box 82-144, Taipei, Taiwan

[21] Appl. No.: 09/459,491

[22] Filed: Dec. 13, 1999

[30] Foreign Application Priority Data

Dec. 24, 1998 [TW] Taiwan ..... 087221518

[51] Int. Cl.[7] ..... A46B 15/00; A46B 9/04

[52] U.S. Cl. ..... 15/105; 15/167.1

[58] Field of Search ..... 15/105, 167.1

[56] References Cited

U.S. PATENT DOCUMENTS

| | | | |
|---|---|---|---|
| 4,253,212 | 3/1981 | Fujita | 15/167.1 |
| 5,044,037 | 9/1991 | Brown | 15/105 |
| 5,133,102 | 7/1992 | Sakuma | 15/167.1 |
| 5,134,743 | 8/1992 | Hukuba | 15/105 |
| 5,572,762 | 11/1996 | Scheiner | 15/105 |
| 5,673,451 | 10/1997 | Moore | 15/105 |
| 5,924,159 | 7/1999 | Haitin | 15/105 |

FOREIGN PATENT DOCUMENTS

| | | | |
|---|---|---|---|
| 0199158 | 10/1986 | European Pat. Off. | 15/105 |

*Primary Examiner*—Randall E. Chin
*Attorney, Agent, or Firm*—A & J

[57] ABSTRACT

A water-proof electronic sound and light tooth brush including a handle and a brush head. The handle is a hollow body formed from a light permeable material, and is adapted to receive a sound and light control device. A tail end thereof is provided with a resonance box. The sound and light control device includes a battery adapted to provide electric power, and a contact switch for actuating a micro central processing unit. The contact switch includes a metal sleeve having an opening and accommodating therein a movable metal ball, the opening of the metal sleeve facing a metal piece remote from the metal sleeve in a non-contact relationship, such that the metal sleeve and the metal piece respectively contact the positive and negative terminals. Furthermore, the micro central processing unit is connected to a music integrated circuit and a speaker thereof. The speaker is provided near an elastic water-proof sound permeable film of the resonance box. The micro central processing unit is further connected to a large-size light emitting diode, and an array of small-sized light emitting diodes, such that the large-size LED is disposed in a hollow connecting portion between the handle and the brush head.

1 Claim, 3 Drawing Sheets

WATER-PROOF ELECTRONIC SOUND AND LIGHT TOOTHBRUSH

BACKGROUND OF THE INVENTION (a) Field of the Invention

The present invention relates to a water-proof electronic sound and light tooth brush, more particularly to a tooth brush structure that can display sound and light effects during brushing.

(b) Description of the Prior Art

Maintaining oral hygiene is very important for everyone, especially for children. However, for those children who are impatient with brushing, parents have a hard time asking them to brush their teeth properly. In order to encourage children to brush their teeth, there are available tooth brushes formed with cartoon figures. However, such tooth brushes with cartoon figures are only static attractions. If there is a tooth brush that can generate sound and light effects during brushing, children would love it and love to brush their teeth.

SUMMARY OF THE INVENTION

The present invention relates to a water-proof electronic sound and light tooth brush, more particularly to a tooth brush structure that can display sound and light effects during brushing.

A primary object of the present invention is to provide a water-proof electronic sound and light tooth brush, which can generate sound and light with the brushing action of the user.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
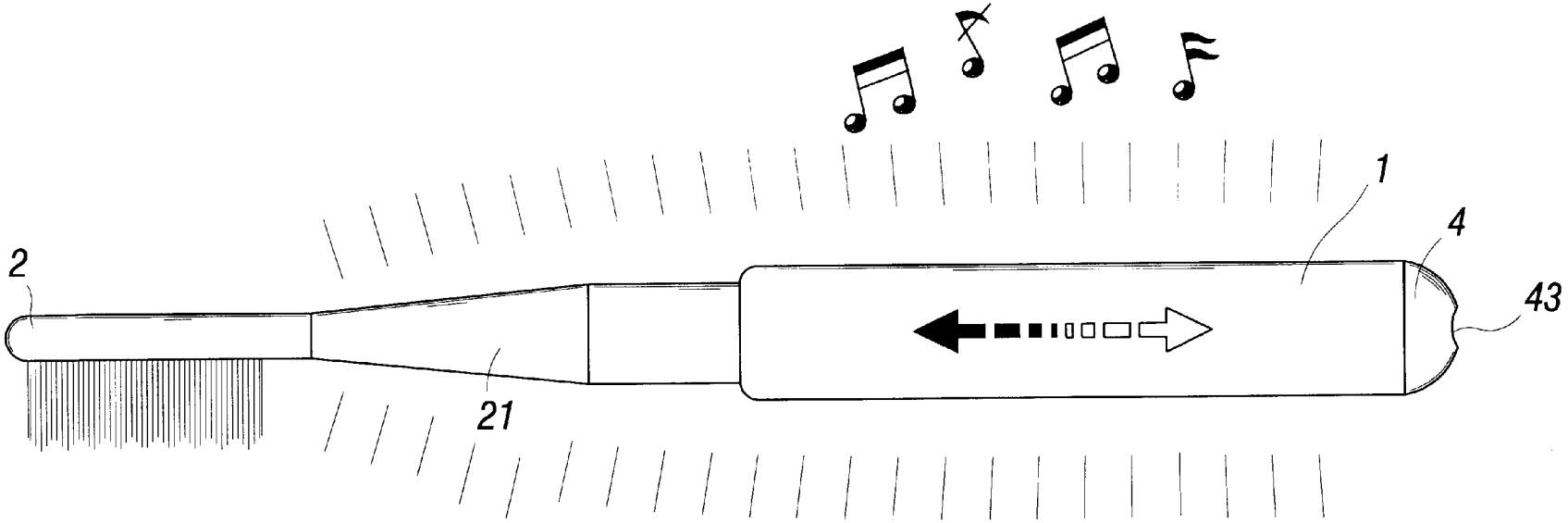
FIG. 1 is an exterior structural view of a preferred embodiment of the present invention.

With reference to FIGS. 1 to 4, the present invention includes a handle 1, and a brush head 2.

The handle 1 is a hollow body formed from a light permeable material, and is adapted to receive a sound and light control device 3. A tail end thereof is provided with internal threads 11 for engaging a threaded portion 42 projecting from a resonance box 4 having a water-proof washer 41.

The resonance box 4 is substantially hollow, and has an outer periphery provided with a through hole 43 adapted for sound guidance and water discharge. The resonance box 4 has an elastic water-proof sound permeable film 44 secured inside in the vicinity of the threaded portion 42.

The sound and light control device 3 includes a battery 31 adapted to provide electric power, and a contact switch 33 for actuating a micro central processing unit (CPU) 32. The contact switch 33 includes a metal sleeve 331 having an opening and accommodating therein a movable metal ball 32, the opening of the metal sleeve 331 facing a metal piece 333 remote from the metal sleeve 331 in a non-contact relationship, such that the metal sleeve 331 and the metal piece 333 respectively contact the positive and negative terminals. Furthermore, the micro central processing unit 32 is connected to a music integrated circuit (IC) 34 and a speaker 35 thereof. The speaker 35 is provided near the elastic water-proof sound permeable film 44. The micro central processing unit 32 is further connected to a large-size light emitting diode (LED) 36, and an array of small-sized light emitting diodes (LED) 37, such that the large-size LED 36 is disposed in a hollow connecting portion 21 between the handle 1 and the brush head 2.

The brush head 2 has the above-mentioned connecting portion 21, the inner periphery thereof being formed into a light bending flange 211.

Figure 5:
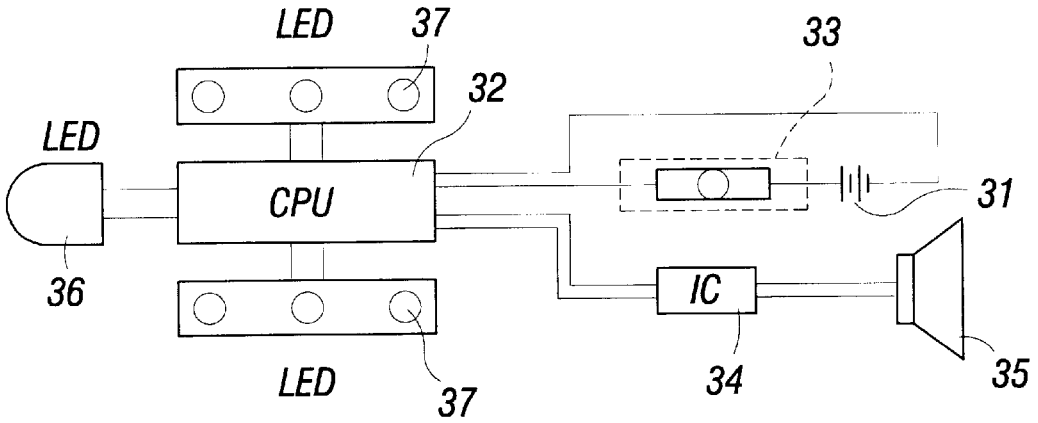
FIG. 5 is a circuit block diagram of a sound and light control device of the preferred embodiment.

FIG. 5 is a circuit block diagram illustrating the present invention in operation. In use, brushing movement will cause the metal ball 332 of the contact switch 33 to intermittently, electrically connect the positive and negative terminals respectively connected to the metal sleeve 331 and the metal piece 333. Therefore, the action of actuation follows with the action of brushing. In addition, the micro central processing unit 32 is configured to enable the loop to maintain electrical connection for an interval of 6 seconds at each single actuation. Actuation can be continuous, and electrical connection can be maintained for a longer interval of time. Besides, after actuation has been stopped, electrical connection is automatically stopped. Therefore, the contact switch 33 is actuated with the action of brushing, and the micro central processing unit 32 is electrically connected to control the large-size LED 36 and the small-size LED 37 to flash, while the music recorded on the music IC 34 is played via the speaker 35. With the continuous brushing action that results in actuation of the contact switch 33, the LED continues to flash, and music continues to play, generating special sound and light effects. Such effects can draw children's attention and can enhance their interest in brushing teeth to keep oral hygiene.

Figure 2:
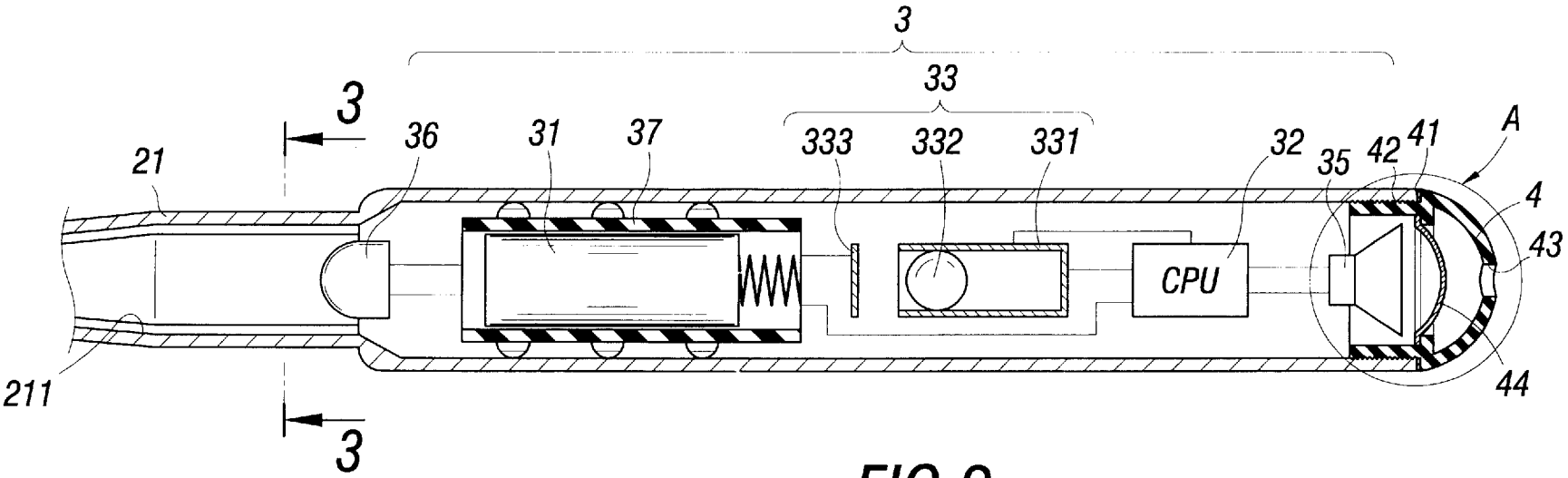
FIG. 2 is a sectional view of the preferred embodiment.
Figure 3:
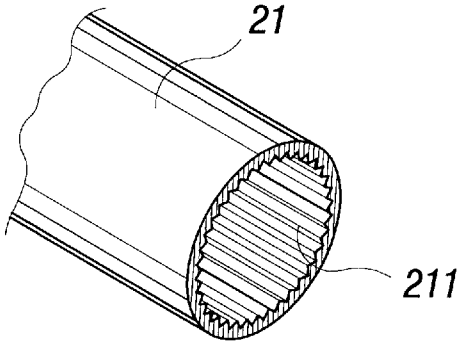
FIG. 3 is a cross-section taken along line 3—3 of FIG. 2.
Figure 4:
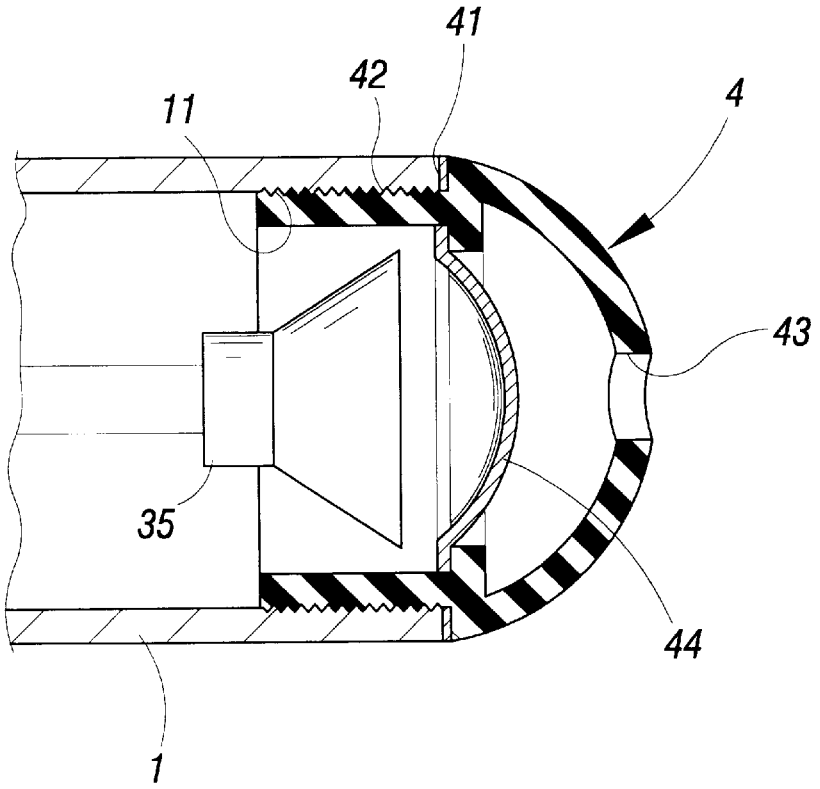
FIG. 4 is an enlarged view of the portion "A" in FIG. 2.

Furthermore, referring to FIG. 4, the sound from the speaker 35 is resonated in the resonance box 4 before being emitted through the through hole 43. The elastic water-proof sound permeable film 44 is provided between the speaker 35 and the resonance box 4 to permit emission of sound while preventing entry of water. The water-proof washer 41 is provided between the resonance box 4 and the tail end of the handle 1 to further ensure the water-proof effect. With further reference to FIGS. 2 and 3, by means of the light bending flange 211 at the inner periphery of the hollow connecting portion 21 of the brush head, the flashing light of the large-size LED 36 is transmitted and scattered to the head end. The flashing light of the small-size LED 37 is radiated directly through the handle 1. In summary, the present invention utilizes the user's brushing action to actuate the contact switch 33 to enable electrical connection of the micro processing unit 32, so that the LED keeps on flashing and music keeps coming from the speaker 35. Such light and sound effects are good incentives to encourage children to brush their teeth and hence maintain oral hygiene. Besides, when not in use, even if the metal ball 332 of the contact switch 33 is located at the positive and negative terminals of the metal sleeve 331 and the metal piece 333, since the micro central processing unit 32 does not receive a continuous actuation signal, electrical connection will be stopped after the set 6-second interval to ensure against abnormal actuation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A water-proof, electronic sound and light tooth brush, comprising a handle and a brush head, wherein said handle is a hollow body formed from a light permeable material for receiving a sound and light control device, a tail end thereof being provided with internal threads for engaging a threaded portion projecting from a resonance box, said resonance box having a water-proof washer, said resonance box being substantially hollow, and having an outer periphery provided with a through hole adapted for sound guidance and water discharge, said resonance box having an elastic water-proof sound permeable film secured inside in the vicinity of said threaded portion;

said sound and light control device including a battery adapted to provide electric power, and a contact switch for actuating a micro central processing unit, said contact switch including a metal sleeve having an opening and accommodating therein a movable metal ball, said opening of said metal sleeve facing a metal piece remote from said metal sleeve in a non-contact relationship, such that said metal sleeve and said metal piece respectively contact positive and negative terminals, said micro central processing unit being connected to a music integrated circuit and a speaker thereof, said speaker being provided near said elastic water-proof sound permeable film, said micro central processing unit being further connected to a large-size light emitting diode, and an array of small-sized light emitting diodes, such that said large-size LED is disposed in a hollow connecting portion between said handle and said brush head; and an inner periphery of said connecting portion of said brush head is formed into a light bending flange.

* * * * *